United States Patent [19]

Beerens

[11] Patent Number: 4,593,591

[45] Date of Patent: Jun. 10, 1986

[54] CHAIN SAWS AND CHAINS THEREFOR

[76] Inventor: Cornelis J. M. Beerens, 40-42 Berkshire Road, North Sunshine, Victoria, Australia

[21] Appl. No.: 557,185

[22] PCT Filed: Mar. 30, 1983

[86] PCT No.: PCT/AU83/00037

§ 371 Date: Nov. 29, 1983

§ 102(e) Date: Nov. 29, 1983

[87] PCT Pub. No.: WO83/03379

PCT Pub. Date: Oct. 13, 1983

[30] Foreign Application Priority Data

| | | | |
|---|---|---|---|
| Mar. 30, 1982 | [AU] | Australia | PF3368/82 |
| Aug. 6, 1982 | [AU] | Australia | PF5248/82 |
| Nov. 24, 1982 | [AU] | Australia | PF6955/82 |

[51] Int. Cl.[4] ..... B27B 33/14; B27B 17/02

[52] U.S. Cl. ..... 83/834; 83/833

[58] Field of Search ..... 83/830–834

[56] References Cited

U.S. PATENT DOCUMENTS

| | | | |
|---|---|---|---|
| 2,771,919 | 11/1956 | Cox | 83/834 |
| 4,408,393 | 10/1983 | Jerabek | 83/833 X |
| 4,484,504 | 11/1984 | Atkinson | 83/834 X |

*Primary Examiner*—James M. Meister

*Attorney, Agent, or Firm*—Wigman & Cohen

[57] ABSTRACT

A chain saw having a bar (51) with a sprocket (50) rotatably mounted in the nose, and a chain with cutter links (52) mounted to travel along the periphery of the bar (51). The driving tongues (54) of the chain and the gullets (50*a*) between the teeth of the sprocket (50) being shaped so that when they interfit as the chain passes around the nose of the bar, the rear end (6) of each cutter link (52) is raised relative to cutting edge (67) so that said rear end (6) follows a path about the sprocket (50) outwardly of the path travelled by the cutting edge (67).

11 Claims, 11 Drawing Figures

CHAIN SAWS AND CHAINS THEREFOR

This invention relates to chain saw bars and to a chain for use in combination with such a bar.

The invention is particularly directed to a chain saw bar of the type having a sprocket or a roller rotatably supported at the forward end of the bar, to guide the chain as it travels from the top to the bottom edge of the bar. Chain saw bars of these constructions are commonly referred to as "sprocket nose bars" and "roller nose bars" respectively.

Throughout this specification the reference to a "chain saw chain" means a chain comprising a plurality of alternate cutter links and connector links with drive links connecting each cutter link to the respective adjacent connector links. Each drive link is a single member located centrally of the width of the chain, and has a dependent tongue to be received between successive teeth of a driving sprocket. The cutting links each comprise a body portion with transverse apertures for pivotally connecting the cutter link to the respective adjoining drive links, and a transverse land integral with the body portion having a cutting edge at the forward end and a heel at the rearward end. A depth gauge projection is provided forward of the cutting edge.

One of the major problems associated with the use of a chain saw is the tendency of the saw to kick back towards the operator, when the section of the chain passing around the nose of the bar is being used to cut material. In these circumstances, the reaction force to the cutting action of the chain tends to throw the nose end of the bar upwardly and backwardly towards the operator. Hence the saw tends to pivot in this direction in the hands of the operator, and may come into contact with the body of the operator, and cause serious injury thereto.

The degree of severity of kick back is relative to the depth of cut being made by that portion of the chain travelling around the nose of the bar. In a conventional chain, the depth of cut is controlled by the depth gauge protection on the cutter link in advance of the cutting edge. If the depth gauge projection was set so that a relatively small cut is made by each cutter link, the severity of kick back would be reduced. However, this would also result in a reduction of the cutting rate of the chain when being used on the straight portion of the cutter bar and is therefore undesirable.

In addition, the depth gauge projection on a conventional chain, can induce a degree of kick back, for as the chain passes around the curved nose portion of the bar, the depth gauge projection take up an attitude to the surface of the cut, which will allow the depth gauge projection to dig into the material in a manner similar to the cutting edge. This digging in of the depth gauge projection produces the same type of reaction as the cutting edge of the cutter link, and so also contributes to the risk of kick back. Further as the cutter link undergoes changes in angular attitude to the cut surface of the material, as it passes around the nose portion of the bar, the cutting edge of the cutter link may take a deeper cut than is possible when the chain is moving along the straight portion of the bar.

Thus, at present, it is necessary to make a compromise between the acceptable rate of cutting when operating on the straight portion of the bar, and the degree of safety required when cutting with the nose portion of the bar.

Skilled operators of chain saws are aware of the tendency for the saw to kick back, and accordingly take precautions to guard against possible injury, when using the nose portion of the bar for cutting. However, there are other occasions when the nose portion of the chain may accidentally come in contact with an object that offers resistance to the cutting action of the cutter link and therefore kick back may occur when the operator is not prepared. Also it will be appreciated that risk of kick back and resultant serious injury are always present when a chain saw is being used by an unskilled operator.

It is the object of the present invention to provide a chain saw bar, and a chain saw chain which will eliminate or at least reduce the risk of kick back when cutting with the nose portion of the bar, without sacrificing the cutting efficiency when cutting with the chain on the straight portion of the bar.

With this object in view there is provided a chain saw including a chain saw chain as hereindefined supported on a chain saw bar to travel about the periphery thereof, the nose portion of the bar and the chain being adapted to co-operate in use so that portion of the transverse land of the cutter link rearward of the cutting edge travels a path radially outward of, or the same as, the path travelled by the cutting edge of the cutter link.

It will be appreciated that if a portion of the cutter link rearward of the cutting edge travels a path radially outward of that travelled by the cutting edge, as it is travelling around the nose of the bar then the cutting edge will not contact the material being cut. Also as the depth gauge projection of the cutter link travels a path inward of that of the cutting edge it will be clear of the material, and will therefore not promote kick back.

In a conventional cutter link the surface of the transverse land, rearward of the cutting edge is inclined downwardly from the cutting edge to the heel to provide clearance when the cutter link is travelling on the straight portion of the bar. Accordingly the degree that the rear end of the cutting link is required to be raised to follow a path around the nose of the bar outwardly of that of the cutting edge is influenced by the inclination of the said surface. Also the length of the transverse land rearward of the cutting edge influences the degree that the rear end must be raised to meet the above requirement. The greater the length of the transverse land the closer the heel of the land will normally be to the arcuate path travelled by the cutting edge as the chain passes around the nose of the bar. Accordingly the greater the length of the transverse land, for any selected angle of downward inclination of the transverse land, the less is the degree that the cutter link must be deflected from its normal attitude so as to cause the heel of the transverse land to travel a path the same as or radially outward of the cutting edge.

In a conventional sprocket nose chain saw bar the chain is supported by the sprocket as it passes around the nose of the bar, with the links of the chain clear of the bar. Thus there is no frictional drag between the chain and bar in the nose area, and as the sprocket is normally mounted on a roller bearing, frictional drag and hence wear are substantially avoided.

The only driving forces exerting between the nose sprocket and the chain is that necessary to cause the sprocket to rotate on its bearing, accordingly as is customary in a conventional chain the common centerline of the connecting rivets of each link is at its mid-point at right-angles to a radial line from the centre of the sprocket. Thus the cutter link as it passes around the nose will, in a conventional chain and sprocket construction have substantially the same attitude to the material to be cut, as the cutter link has when travelling along the straight edges of the bar.

However, if the links of the chain are constructed so that, as the chain passes around the nose sprocket, the common centerline of the rivets of the cutter links is inclined downward in the forward direction of travel to the radial line through the mid-point of said common centerline, then the heel of the cutter link is raised and may travel the same path as the cutting edge or a path outwardly thereof. In this way the risk of kick back is reduced.

However, in a convention construction the cutter links are not directly supported by the sprocket but are suspended between the drive links connected to either end thereof. The attitude of the cutter link as it passes around the sprocket is thus controlled by the drive links that are directly supported by the sprocket.

In one embodiment of the invention applicable to a sprocket nose chain saw co-operating surfaces on the drive link tongues of the chain and in the gullets between the teeth of the nose sprocket are arranged so that as the chain passes around the nose sprocket the cutter links are inclined downward in the forward direction so that the heel or another portion of the transverse land rearward of the cutting edge thereof travels the same arcuate path as the cutting edge or outward of that path.

The co-operating surfaces of the driving tongues of the chain and of the gullet between the teeth of the nose sprocket are arranged so that as the chain passes around the nose sprocket the cutter links are inclined downward in the forward direction, said downward inclination of the cutter link being equal to or greater than the extent of inclination necessary to locate the transverse land of the cutter link rearward of the cutting edge to form a chord to a circle concentric with the sprocket.

When the inclination of the cutter link is such that said transverse land forms a chord to the circle then the forward end of the cutting edge and the rear end or heel of the transverse land are each located on the circumference of the circle. In this position the cutting edge will not effectively cut.

If the inclination of the cutter link is greater than that necessary to form the chord to the circle, then the rear end of the transverse land will lie outside of the circumference of the circle passing through the forward end of the cutting edge and concentric with the sprocket. Thus in any such position the heel of the transverse land is moving in a circle of greater radius than the cutting edge and the cutting edge will not effectively cut.

By relating the inclination of the cutter link to the chord of the circle this ensures that subsequent sharpening of the cutting edge does not adversely affect the non kick back characteristic of the saw. If the transverse land rearward of the cutting edge does form a true chord to the circle when the chain is new, subsequent sharpening of the cutting edge will bring that edge inside of the circle. However, irrespective of the degree of sharpening the heel of the transverse land will remain on the circle. Thus sharpening only further reduces the risk of kick back.

The raising of the portion of the cutter link rearward of the cutting edge with respect to the cutting edge thereof, as the cutter link passes around the nose of the chain saw bar may be achieved by making the gullet or driving tongue symmetrical and the other asymmetrical. When the gullet is symmetrical the trailing face of the asymmetrical tongue is more steeply inclined, and when the driving tongue is symmetrical the leading face of the gullet is more steeply inclined.

It will be appreciated that if desired both the gullets in the sprockets and the driving tongues of the chain may be asymmetric and provided the degree of asymmetry is different and sufficient to incline the cutter link inwardly the necessary amount as the cutter links pass around the nose sprocket.

In this specification the asymmetry or symmetry of a nose sprocket gullet is determined in respect to a radial line from the axis of the sprocket passing through the centre of the root of the gullet. Also the asymmetry or symmetry of a driving tongue is determined in respect to a line passing through the centre of the crest of the tongue and at right angles to the common centerline of the two pivot pin receiving apertures of the driving tongue.

The drive links may also be constructed to achieve the required inclination of the cutter link, by retaining the mating faces of the drive tongue and the gullet of the sprocket teeth symmetrical or of conventional configurations and arranging the common centerline of the connecting rivets of the drive link inclined outwardly in the forward direction to the line bisecting the angle between the leading and trailing inclined faces of the drive link. With the drive links so constructed the common centerline of the drive links rivets is outwardly inclined in the forward directions as they pass around the nose supported on the sprocket, and this results in the common centerline of the cutter link rivets to be inwardly inclined in the forward direction.

The included angle between the leading and trailing faces of the drive tongue of conventional chains, varies between manufacturers, and between different chains in the range of one manufacturer. However, it is the standard practice for the trailing face of the tongue of the drive link to be inclined at an angle of 50° to the common centerline passing through the rivets of the drive link which connect it to the adjacent links of the chain. This inclination of the trailing face has been commonly accepted as the preferred angle to obtain effective driving engagement between the drive sprocket of the saw and the drive links of the chain. It is also the widely accepted practice for the included angle between adjacent teeth on the nose sprocket to be in the order to 85° as this has been found to accommodate most of the normal chains currently in use. The teeth of the nose sprocket are also symmetrically arranged so that the bar may be reversed in the saw.

It will be appreciated that currently the principle purpose of the nose sprocket is to guide the chain around the nose area, with the links of the chain clear of the guide bar itself, and thus reduce the frictional drag on the chain. Also as there is an insignificant drive force acting between the nose sprocket and the tongues of the drive links, correct mating of the tongues with the gullet between the sprocket teeth is not essential.

In view of this standard form of the teeth on the nose sprocket, it has been realized that, by an appropriate arrangement of the disposition of the rivets passing through the drive link, a chain can be produced which will operate with most currently used guide bars in a manner to produce a reduction in kick back.

There is thus provided a chain for a chain saw wherein the line bisecting the angle between the forward and trailing faces of the drive link intersects the common centerline to the rivets passing through the drive link, at an angle less than 90°. This angle of inclination of the bisecting line is measured between the bisecting line inward of the common centerline and the common centerline rearward of the bisecting line. Preferably the angle is of the order of 84° to 86°, however, the angle may be as low as about 78°. The extent that the inclination of the bisecting line is below 90° is influence by any asymmetre of the teeth of the nose sprocket. The important feature is that when the chain is fitted to the nose sprocket the common centerline between the rivets of the drive link is upwardly inclined in the forward direction relative to the radial line from the sprocket center to the mid-point of the common centerline of the drive link rivets.

It is convenient to make the angle between the forward and trailing faces of the drive tongue to be of the order of 85° so as to correspond to the included angle between the teeth of the conventional nose sprocket. However, the present invention does significantly contribute to the reduction in kick back even where the drive tongue and sprocket teeth do not neatly interfit.

The invention will be more readily understood from the following description of various practical arrangements of a chain saw and chain as depicted in the accompanying drawings.

Figure 8A:
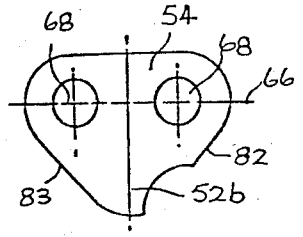
FIG. 8a (PRIOR ART)
Figure 8B:
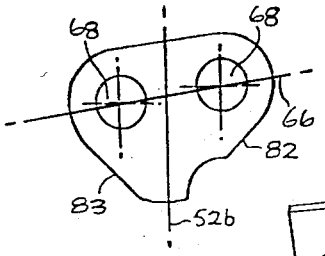

FIGS. 8*a* and 8*b* are side views of a drive link for a chain, FIG. 8*a* showing a conventional drive link, and FIG. 8*b* showing a drive link modified in accordance with the present invention.

Figure 6:
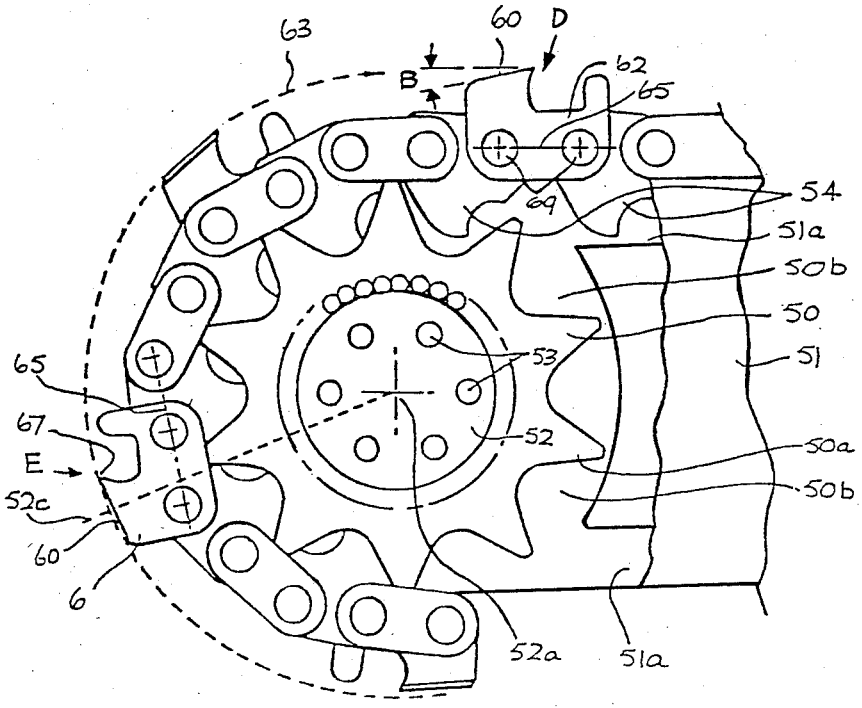
FIGS. 6 and 7 are side views of a sprocket nose bar for a chain saw, partly in section, with a chain fitted thereto to operate in accordance with the invention.
Figure 7:
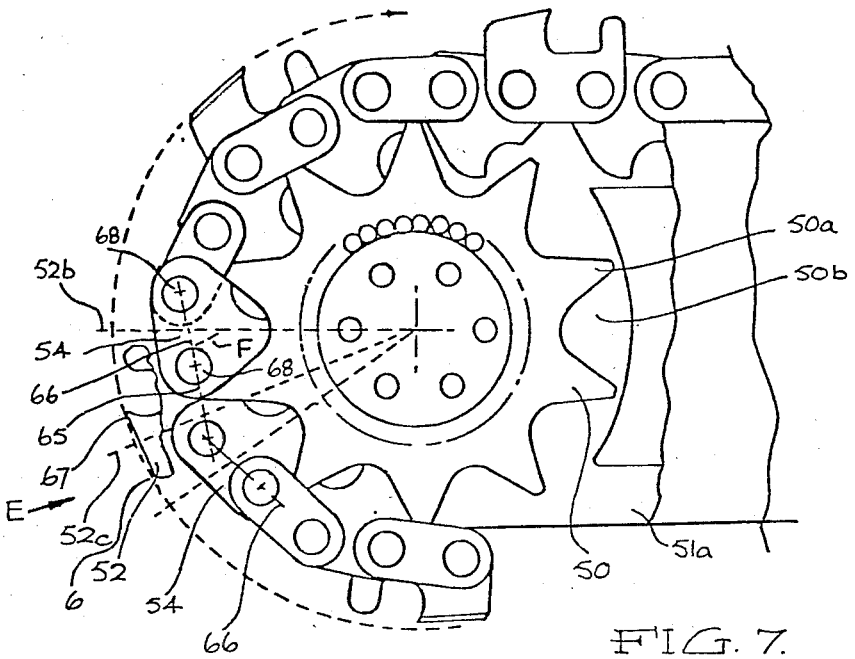
Figure 9:
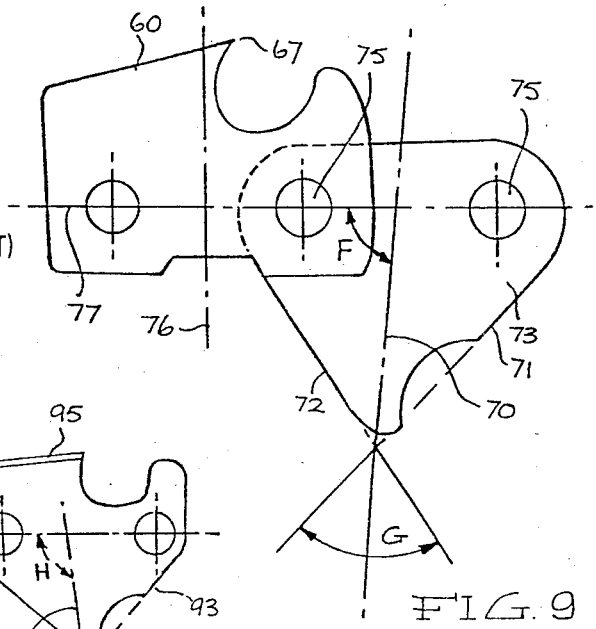

FIG. 9 is a side view of portion of the chain as shown in FIGS. 6 and 7 to a larger scale.

Figure 10:
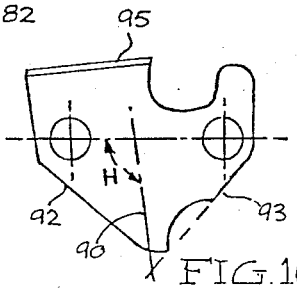

FIG. 10 is a side view of a cutter link for a chain modified in accordance with the present invention.

Figure 2:
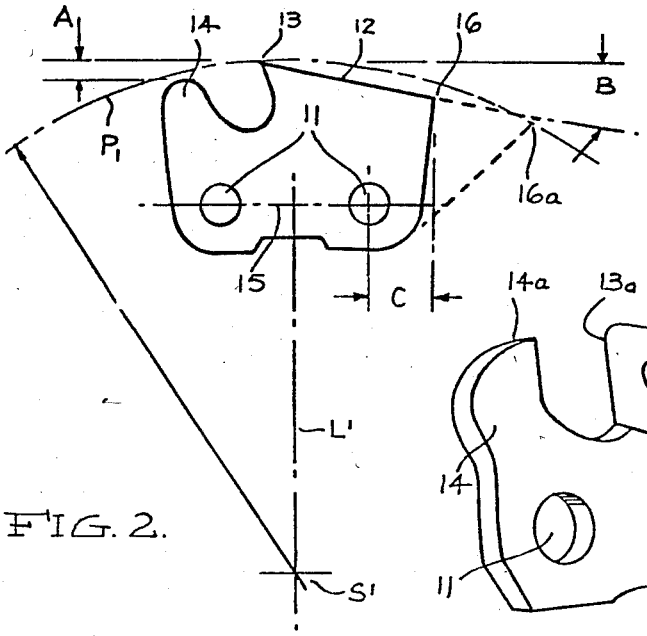
FIGS. 2 and 3 are diagrammatic representations of factors contributing to kick back in the operation of a chain saw, and how it may be avoided.
Figure 1:
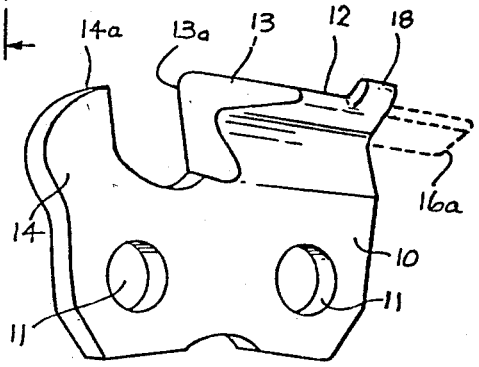
FIG. 1 is a perspective of a cutter link of a chain for a chain saw.

Referring first to FIGS. 1 and 2 of the drawings, a conventional cutter link as illustrated has a generally planar body portion 10, having two rivet receiving apertures 11 extending therethrough. Integral with the body portion 10 is the land portion 12 extending transversely to the body portion. The forward end of the transverse land forms a cutting edge 13 which also extends at 13*a* into the body portion 10. Spaced forwardly of the cutting edge 13 is a depth gauge projection 14 formed integral with the body portion 10.

As can be best seen in FIG. 2 the rivet receiving apertures 11 are located on a common centerline 15 and the cutting edge 13 is spaced from the centerline 15 a greater distance than is the upper extremity 14*a* of the depth gauge projection 14. The depth of cut that would be made by the cutter link when moving along a straight portion of a chain saw bar is the difference in height between the extremity 14*a* and the cutting edge 13, indicated as "A" in FIG. 2.

The upper surface of the transverse land portion 12 is substantially flat, and is inclined downwardly from the cutting edge 13 to the heel 16 at an angle B. This provides clearance immediately behind the cutting edge 13 to assist in the cutting action. When this cutter link is incorporated in a conventional chain, and the chain is supported on the curved nose portion of a chain saw bar of prior known construction, the cutting edge 13 would follow the arcuate path indicated at $P_1$ having a center $S_1$. As can be seen both the extremity 14*a* of the depth gauge projection 14 and the heel 16 are spaced inwardly from path $P_1$, so the cutting edge 13 would engage the material to be cut as it passes around the nose of the bar and cutting would occur. Since the cutting edge is effecting cutting then the risk of kick back is present.

Figure 3:
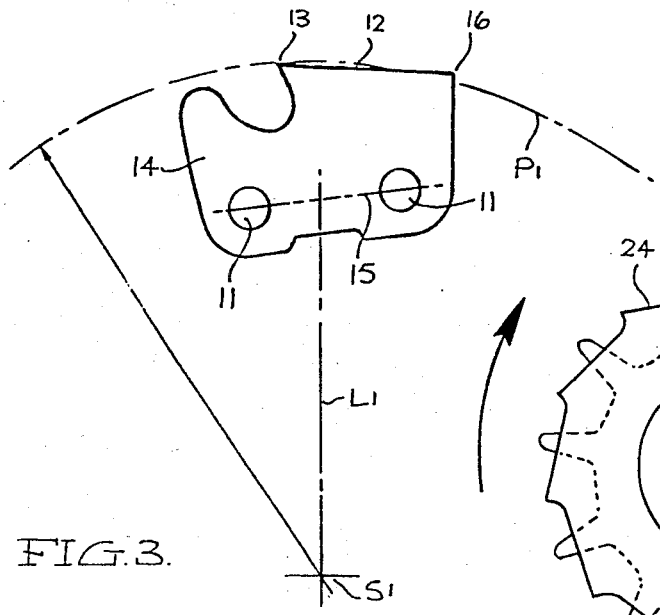

Referring now to FIG. 3 of the drawings there is shown the same cutter link as illustrated in FIG. 2 but positioned so that the common centerline 15 of the rivet receiving aperture 11 is inclined downwardly in the forward direction to the radial line $L_1$ from the axis $S_1$. to the mid-point of the common centreline 15. It will be noted that, as a result of the repositioning of the cutter link, the heel 16 of the cutter link is now located outwardly of the path $P_1$ of the cutting edge 13. Accordingly as the cutter link passes around the nose of the bar the heel 16 will engage the material to be cut and the cutting edge 13 will be held clear of the material. It will also be noted that the extremity 14*a* of the depth gauge projection 14 will be clear of the material.

The inclining of the cutter link as above described thus eliminates the risk of kick back arising from the cutting action of the cutting edge 13 or from the depth gauge projection digging into the material to be cut.

The degree of inclination of the cutter link to achieve this result is related to the inclination of the upper face of the transverse land 12 as represented by angle "B" in FIG. 2, and the distance the transverse land extends rearward of the rear rivet hole 11 in the cutter link, as indicated at C in FIG. 2. The greater angle B the greater is the required inclination of the cutter link to the radial line $L_1$, and the greater the length C the less the required inclination to line $L_1$. Also the smaller the radius of the path $P_1$ the small is the degree of inclination of the cutter link required.

It will be appreciated from the above description with respect to FIG. 3 that the locating of the heel 16 of the transverse land 12 outwardly of the arcuate path $P_1$ may also be achieved solely by increasing the distance C. Such an extension of the transverse land 12 is shown in broken outline at 16*a* in FIGS. 1 and 2. The degree of extension of the transverse land 12 required to locate the heel outwardly of the path $P_1$ is increased with increase in the angle B. As an alternative to increasing the distance C the transverse land 14 may be provided with an outward projection 18 as shown in FIG. 1. This projection reduces the degree of outward inclination of the cutter link required to prevent kick back. It is sufficient for the outer extremity of the projection 18 to be outward of the arcuate path $P_1$ of the cutting edge when the cutter link passes around the nose of the bar.

A further factor that determines the degree that the cutter link must be inclined or the transverse land extended in order to locate the heel outwardly of the path $P_1$ is the radius of the nose of the bar. As the radius of the nose decreases the degree of inclination of the cutter link, or extension of the transverse land required decreases.

Figure 4:
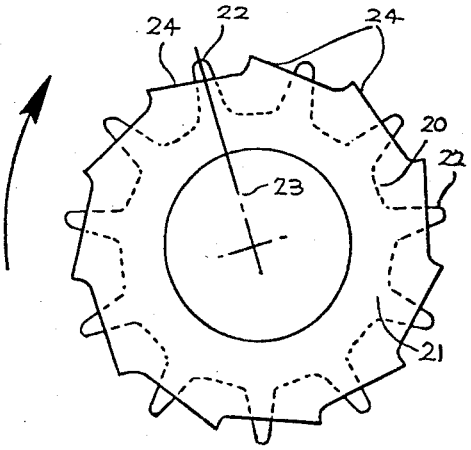
FIG. 4 is a side view of the nose sprocket for a chain saw adapted to operate in accordance with the invention.

FIG. 4 of the drawings illustrates a modification to a conventional sprocket so that the cutter link will be inclined as above discussed as it passes around the nose of the bar. In this construction the plate 20 is secured to one side of the sprocket 21, and if desired a similar plate may be secured to the other side. The sprocket 21 is of conventional construction having a plurality of equally spaced teeth 22 to co-operate with the drive tongues of the chain in the normal manner. The peripheral surface of the plate 20 has a series of flat faces 24, one flat face associated with each tooth 22 of the sprocket.

Each flat face 24 is inclined inwardly in the forward direction to the radial line 23 from the sprocket centre through the crest of the associated tooth. In use the sprocket and plate are assembled to the bar of a chain saw to rotate about an axis normal to the plane of the bar, and so that each face 24 is inclined inwardly in the forward direction of the rotation of the sprocket. The degree of inclination is such that, when a chain is in operating relation on the sprocket and plate, each cutter link is supported on a flat face 24 so the heel of the link is on the same or outwardly of the arcuate path of the cutting edge in the manner previously discussed.

It is to be understood that in this particular construction the form of the teeth of the sprocket, or of the drive link tongues of the chain are not important. The supporting of the cutter links on the inwardly inclined faces 24 is the feature which achieves the avoidance of kick back, and the sprocket may be omitted if desired.

In the construction as illustrated a flat face on the plate is provided to associate with each tooth of the sprocket, however, as only each alternate tooth co-operates with a cutter link of the chain it is only essential for the plate to have a flat face associated with each alternate tooth of the sprocket. This later construction may result in the chain being incorrectly fitted so that the cutter links co-operate with the teeth without associated flat faces on the plate. When so assembled there would be an increase in the risk and severity of kick back rather than a reduction. Accordingly it is preferable for the plate to provide one flat face in association with each sprocket tooth.

Figure 5:
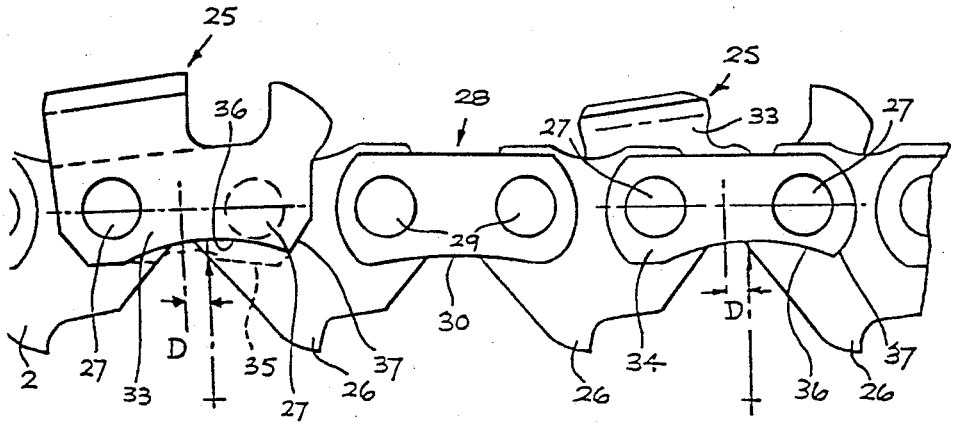
FIG. 5 is a side view of portion of a chain for a chain saw adapted to operate in accordance with the invention on a 'hard nose' or 'roller nose' chain saw bar.

Illustrated in FIG. 5 is a chain for a chain saw which has been modified in accordance with the present invention to operate in conjunction with a conventional "hardnose" or "roller nose" bar.

A conventional "hardnose" bar is one wherein the nose is integral with the remainder of the bar, and is of a generally semi-circular shape to guide the chain from the top edge to the bottom edge of the bar. The central groove in the top and bottom edges of the bar to receive the tongues of the drive links continues around the edge of the nose.

A conventional "roller nose" bar is one wherein the nose is in the form of a roller rotatably supported on the remainder of the bar so the chain is supported on and guided by a portion of the periphery of the roller as the chain passes from the top edge to the bottom edge of the chain. The roller has a central peripheral groove aligned with the grooves in the top and bottom edges of the bar to receive the drive link tongues.

The general construction of the chain shown in FIG. 5 is conventional, comprising cutter links 25, pivotally connected at each end to respective drive links 26 by rivets 27. Each drive link is connected to the next adjacent drive link by a connector link 28, and rivets 29. Each drive link is a single member and each connector link 28 is a pair of members 30, each of the same shape, and located on opposite sides of the drive links. Each cutter link 25 comprises a member 33, the general construction of which is as described with reference to FIG. 1, and a tie strap 34 of the same shape as the members 33 of the connector link 28.

In a conventional chain the lower edge of the members 30 of the connector link and the lower edge of the member 33 and tie strap 34 of the cutter link, each have a central contoured portion 35. This contoured portion is provided to reduce the area in contact with the bar and hence reduce the friction drag. (In FIG. 5 the conventional shape of the lower edge of the cutter link and tie strap is shown in broken outline).

In accordance with the present invention the lower edge of the member 33 and of the tie strap 34 of the cutter link have a concave shaped portion 36 which is offset towards the forward end 37 of the cutter link. The radius of the concave portion 36 is substantially the same as the radius of the nose portion of the bar or the nose roller on which the chain is used. As this chain passes around the nose portion of the bar the cutter link will tilt downwardly at the forward end as the concave portion 36 mates with the nose portion of the bar.

The degree of offset of the center of the curvation of the concave portion 36 from the center of the cutter link, as indicated at D, is selected so that the cutter link will tilt to an extent so the heel 39 of the cutter link is on the same path as the cutting edge 40 or outwardly of that path as it passes around the nose of the bar. As previously described this relationship between the paths of the heel and cutting edge avoid kick back from the cutting edge or depth gauge projection digging into the material being cut.

Referring now to FIGS. 6 and 7, there is shown a chain and the complementary nose portion of a sprocket nose bar of a chain saw embodying the present invention. The chain saw bar 51 is of a conventional construction, being partly in section at the nose end to show the internal nose sprocket 50 and the chain passing therearound. The bar 51 is provided with a conventional longitudinal extending edge grooves **51*a* on the top and bottom surfaces thereof to receive the drive link tongues 54 of the chain, with the cutter links and connector links of the chain riding on the edges of the bar on opposite sides of the respective grooves 51*a***.

The nose sprocket 50 is of the conventional form and is rotatable supported on the stationary boss 52 secured by the plurality of rivets 53 to the bar 51. A series of rollers 53 are interposed between the sprocket 50 and the boss 52 to provide the support for the sprocket. This bearing construction is conventional in a number of chain saw bars.

The sprocket 50 is of a conventional type having evenly spaced teeth **50*a* of symmetrical form which provide between adjacent teeth, gullets 50*b*, again of symmetrical form. The symmetry of the teeth and gullets of the sprocket is in respect of radial lines passing through the axis 52*a*** of the sprocket and the centre point of the crest of the teeth and of the root of the gullets respectively.

As can be best seen at 'D' in FIG. 6 the cutter link 62 has a face 60 extending rearwardly from the cutting edge 67. The face 60 is inclined inwardly towards the rear relative to the common centerline 65 of the rivets 69 at an angle 'B', to provide clearance when cutter link is cutting.

In order to reduce the risk of kick back it is presently proposed to tilt the cutter link as it passes around the nose sprocket as indicated at 'E'. The degree of tilt is such that the face 60 forms a chord to the circle 63 described by the cutting edge of the cutter link as it passes around the sprocket. Thus the face 60 is at right angles to the radial lines 52*c* with the forward end of the cutting edge 67 and the rear end 6 of the face 60 both lying on the circle 63. Subsequent sharpening of the cutting edge will result in the cutting edge moving inwardly of the circle 63 (as shown in dotted outline) and hence further reduces the risk of kick back. It is to be understood that the circle 63 is determined when the chain is in the new condition prior to any resharpening.

The tilt or inclination of the cutter link required to locate the face 60 in the chordal relation to the circle 63 is as previously discussed related to the angle 'B' and the length of the face 60 rearward of rear rivet 69. The kick back reduction effects is also achieved if the tilt of the cutter link is increased such that the face 60 will extend from the cutting edge 67 completely outwardly of the circle 63.

In a sprocket nose bar the cutter links are not directly supported by the sprocket, but are supported by the drive links which in turn are supported between the teeth of the sprocket. Thus by arranging the drive links so the common centerline of the rivets therein is outwardly inclined in the forward direction, the common centerline of the rivets in the cutter link will be inwardly inclined in the forward direction.

FIG. 7 of the drawing is a view the same as FIG. 6 but with part of the cutter link 52 at 'E' broken away to show the disposition of the drive links 54. It will be noted that the common centerline 66 rivets holes 68 of the drive link 54 is inclined upwardly in the forward direction of movement of the chain at an angle 'F' to the radial lines 52*b* that passes through the center of the gullet 50*b*. If the cutter link face 60 is to occupy a chordal relation to the circle 63 then the angle 'F' will be less than 90° and normally of the order of (90−B)°.

In order to achieve the required inclination of the common centerline 66 of the drive links 54, when using a symmetrically shaped drive link and sprocket teeth, it is necessary to rearrange the relative disposition of the rivet holes 68 in the drive link.

Refer now to FIGS. 8*a* and 8*b*, wherein FIG. 8*a* shows a conventional drive link and FIG. 8*b* shows the arrangements of the holes in the drive link that may be used with a conventional sprocket.

The conventional drive link shown in FIG. 8*a* has leading and trailing faces 82 and 83 which co-operate with complementary faces on the gullet in the sprocket when in use. The trailing and leading faces may be equally inclined to the radial line 52*b*, in which case the complementary faces of the gullet would be equally inclined. Alternatively, as in some known constructions the inclination of the faces 82 and 83 to the line 52*b* differ, and in those instances the complementary faces on the gullet would be similarly differently inclined to the radial line 52*c*. However, irrespective of the arrangement, the conventional drive link has the common centerline 66 of the holes 68 at right angles to the radial line 52*b*.

In the drive link construction shown in FIG. 8*b*, the faces 82 and 83 are again equally inclined to the radial line 52*b* as discussed above. However, in this construction, the disposition of the holes 68 are such that the common centerline 66 is inclined to the radial line 52*b* so that in use the hole at the leading end of the drive link is located further from the axis of the sprocket than is the hole at the trailing end of the drive link. This variation can be achieved by leaving either one of the holes in the conventional location and moving the other hole or both the holes may be moved relative to the conventional position as indicated in FIG. 8*b*. In this construction the angle 'F' between the radial line 52*b* and the common centerline 66 is preferably of the order of (90−B)° as previously discussed. However, in some instances, it may be acceptable not to completely eliminate the risk of kick back, and to merely reduce the potential severity thereof by permitting the face 60 of the cutter link to extend slightly inwardly from the circle 63.

There has been discussed earlier in this specification the fact that it is current practice for the trailing face of the tongue of the drive link to be inclined at an angle of 50° to the common centerline passing through the rivets of the drive link which connect it to the adjacent links of the chain. Also as previously explained it is widely accepted practice for the included angle between adjacent teeth on the nose sprocket to be in the order of 85° as this has been found to accommodate most of the normal chains currently in use. The teeth of the nose sprocket are also symmetrically arranged so that the bar may be reversed in the saw.

By an appropriate arrangement of the disposition of the rivet holes in the drive link, a chain can be produced which will operate with most currently used guide bars in a manner to produce a reduction in kick back.

Referring to FIG. 9 the line 70 bisects the angle 'G' between the trailing and leading faces 71 and 72 of the drive link tongue 73, said angle being preferably 85°. The angle 'F' between the line 70 and the common centerline 77 of the rivets 75 is then of the order of 84° to 86°, however, the angle may be as low as about 78°. The extent that the angle 'F' is below 90° is influence by the assymetre of the teeth of the nose sprocket.

In currently known cutting links, the cutting edge of the link may be located forward or rearward of the line 76 in FIG. 9 which is normal to the common centerline 77 of the rivets of a cutter link and centrally between the rivet holes of the cutter link. When the cutting edge is forward of the line 76 the angle 'F' of inclination of the bisecting line 70 is preferably increased by comparison to that necessary when the cutting edge is located rearwardly of the line 76. When the cutting edge is forward of the line 76 then the inclination of the bisecting line 70 is preferably of the order of 78° to 82° and more specifically preferably 80°. When the cutting edge is rearward of the line 76 then the angle of inclination of bisecting line 70 is preferably of the order of 82° to 86°, and more specifically preferably 84°.

The selection of the angle of inclination of said bisecting line is also influenced to a degree by the clearance angle on the cutting edge of the cutter link, however, as this angle is normally of the order of 7° to 9° the above referred to range of angles of inclination will accommodate the normal variations in the clearance angle of the cutting edge.

In a conventional chain the angle between the common centerline 77 and the trailing face of link is usually 50°. If the angle between the leading and trailing faces of the drive link remains at the standard figure of 85°, when the common centerline is inclined as in the present invention, then the angle between the trailing face and the common centerline will increase. Thus if the angle 'F' is 80° and the angle 'G' is retained at 85°, the angle between the trailing face 82 and the common centerline 77 is 57½°. Alternatively if it is preferred to maintain the standard 50° angle between the common centerline and the trailing face then the angle between the trailing and leading faces of the drive link may be adjusted, to maintain the required inclination between the bisecting line 70 and the common centerline 77.

In still a further modification the chain could be constructed so that a drive tongue is formed integral with the cutter link, whereby the degree of inclination of the cutter link as it passes around the sprocket, can be obtained by the same considerations as previously referred to, applicable to the drive link tongue. However, as the inclination is now being applied directly to the cutter link the direction of inclination of the bisecting line is opposite to that of the drive link as previously discussed.

A suitable form of such a cutter link is shown in FIG. 10 of the accompanying drawings wherein the line 90 bisecting the angle between the tracking and leading faces 92 and 93, intersects the common centerline 91 of the cutter link rivets 94 at an angle H which is greater than 90° and preferably of the order of (90+B)°. The clearance angle of the face 95 extending rearward from the cutting edge being B°. The angle H is subject to variation dependent on the clearance angle B and the length of the face 95 rearward of the rear rivet 94, as previously discussed.

In each of the constructions previously discussed involving the use of a sprocket nose bar, the required inclination of the cutter link has been achieved by modification of the drive tongue to co-operate with a conventional sprocket. However, it will be readily appreciated that it is the combined effect of the interfitting of the drive tongue with the sprocket that brings about the required disposition of the cutter link as it passes around the nose of the bar. Accordingly the scope of the invention includes constructions wherein modification are made to the sprocket, or to the sprocket and drive tongues to achieve the required disposition of the cutter link.

I claim:

1. A chain saw, comprising:

a bar having a periphery and a nose portion at one end thereof; and a chain supported on the bar to travel about the periphery thereof;

said chain comprising a plurality of cutter links;

a respective drive link pivotally connected by pins to each end of each cutter link;

each cutter link having a transverse land with a cutting edge at the forward end and a heel at the rear end;

each drive link having a dependent tongue to be received between successive teeth of a drive sprocket;

said nose portion of the bar includes an idler sprocket supported by the bar for rotation about an axis normal to the bar;

said idler sprocket having a gullet between respective teeth thereof to receive the drive link tongues of the chain as the chain passes around the nose portion of the bar;

said idler sprocket gullets and the drive link tongues of the chain having leading and trailing faces and being shaped so that when in interfitting relation the drive link common centerline of the pins pivotally connecting the drive link to the links on either side thereof is outwardly inclined in the forward direction of travel of the chain at an angle to the line radial to the idler sprocket axis and passing through the center of the root of the gullet between the idler sprocket teeth in which the drive link tongue is received;

whereby the cutter link common centerline of the pins pivotally connecting the respective cutter links to the drive links at either end thereof is inwardly inclined in the forward direction of travel of the chain at an angle to the line radial to the axis of the idler sprocket and that intersects said cutter link common centerline substantially midway between the pins of the cutter link as it passes around the nose portion of the bar.

2. A chain saw as claimed in claim 1, wherein the inclination of said cutter link common centerline is at least that required so the heel of the land of the cutter link follows the same path as the cutting edge around the nose portion of the bar.

3. A chain saw as claimed in claim 1, wherein the leading and trailing faces of the respective gullets of the idler sprocket are arranged at an angle that is substantially equal to an angle formed between leading and trailing faces of the respective drive link tongues, and the drive link common centerline is inclined outwardly in the forward direction to the line bisecting said angle of the drive link tongue.

4. A chain saw as claimed in claim 3, wherein the angle between said bisecting line inwardly of said drive link common centerline and rearward of the bisecting line is substantially between 78° and 86°.

5. A chain saw as claimed in claim 4, wherein said angle is substantially between 82° and 86°.

6. A chain saw as claimed in claim 3, wherein the angle between the leading and trailing faces of the drive link tongue is 85°.

7. A chain saw as claimed in claim 4, wherein the angle between the leading and trailing faces of the drive link tongue is 85°.

8. A chain saw as claimed in claim 5, wherein the included angle between the leading and trailing faces of the drive link tongue is 85°.

9. A chain saw as claimed in claim 3, wherein the trailing face of the drive link is inclined at substantially 50° to the drive link common centerline.

10. A chain saw chain adapted for use on a chain saw having a bar with a straight portion and a nose portion at one end thereof, comprising:

a plurality of cutter links each having a cutting portion and a land portion rearward of said cutting portion;

a plurality of connecting links alternately arranged between the cutter links;

pins interconnecting the cutter links to the connecting links;

said pins arranged on the cutter links such that a centerline through the center of the cutter link pins is parallel to the direction of travel of the cutter links along the straight portion of the bar;

drive tongues depending from one of the cutter links and the connecting links;

said drive tongues arranged to engage with an idler sprocket in the nose portion of the bar such that the centerline is inclined inwardly in the forward direction with respect to the tangential direction of travel of the cutter link as the cutter link passes around the nose of the bar;

whereby when the cutter link passes around the nose of the bar the land portion travels in a path having a radius at least as great as the radius of the path travelled by the cutting surface.

11. The chain saw chain according to claim 10, wherein the drive tongues depend from the connecting links.

* * * * *